US009969523B2

(12) United States Patent
Ayerst

(10) Patent No.: US 9,969,523 B2
(45) Date of Patent: May 15, 2018

(54) CARTON WITH DISPLAY FEATURE

(71) Applicant: Graphic Packaging International, Inc., Atlanta, GA (US)

(72) Inventor: Robert Ayerst, Atlanta, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 117 days.

(21) Appl. No.: 15/286,729

(22) Filed: Oct. 6, 2016

(65) Prior Publication Data

US 2017/0101213 A1 Apr. 13, 2017

Related U.S. Application Data

(60) Provisional application No. 62/239,415, filed on Oct. 9, 2015.

(51) Int. Cl.
*B65D 5/72* (2006.01)
*B31B 3/26* (2006.01)
(Continued)

(52) U.S. Cl.
CPC ..... *B65D 5/725* (2013.01); *B31B 3/26* (2013.01); *B65D 5/16* (2013.01); *B65D 5/4266* (2013.01); *B65D 5/4608* (2013.01); *B65D 5/5405* (2013.01); *B65D 71/36* (2013.01); *B31B 2201/909* (2013.01); *B31B 2203/066* (2013.01); *B31B 2203/10* (2013.01); *B65D 2571/0045* (2013.01); *B65D 2571/0066* (2013.01); *B65D 2571/00141* (2013.01); *B65D 2571/00574* (2013.01); *B65D 2571/00728* (2013.01); *B65D 2571/00827* (2013.01); *B65D 2571/00919* (2013.01)

(58) Field of Classification Search
CPC ..... B65D 5/725; B65D 5/16; B65D 5/4266; B65D 5/5405; B65D 5/4608; B31B 3/26
USPC ..... 206/775, 769, 427, 457, 782, 774
See application file for complete search history.

(56) References Cited

U.S. PATENT DOCUMENTS 499,655 A 6/1893 Clark
642,121 A 1/1900 Hildreth
(Continued)

FOREIGN PATENT DOCUMENTS

DE 2 320 190 11/1973
DE 3627019 2/1988
(Continued)

OTHER PUBLICATIONS

International Search Report and Written Opinion for PCT/US2016/055631 dated Jan. 19, 2017.

*Primary Examiner* — Steven A. Reynolds
(74) *Attorney, Agent, or Firm* — Womble Bond Dickinson (US) LLP

(57) ABSTRACT

A carton for holding a plurality of articles. The carton includes a plurality of panels that extends at least partially around an interior of the carton. The plurality of panels includes a top panel, a bottom panel, a first side panel, and a second side panel. The carton has a display feature including a display opening in at least one of the first side panel and the second side panel, and a display panel foldably connected to the top panel. The display panel is located in the interior and spaced-apart from the opening. The display panel is at least partially visible through the display opening.

31 Claims, 9 Drawing Sheets

(51) Int. Cl.

| | |
|---|---|
| ***B65D 5/16*** | (2006.01) |
| ***B65D 5/42*** | (2006.01) |
| ***B65D 5/468*** | (2006.01) |
| ***B65D 5/54*** | (2006.01) |
| ***B65D 71/36*** | (2006.01) |

(56) References Cited

U.S. PATENT DOCUMENTS 1,503,161 A 7/1924 Hornecker
1,634,073 A 6/1927 Labombarde
1,656,919 A 1/1928 Marsh
1,665,620 A 4/1928 Amatel
1,762,704 A 6/1930 Smith
1,901,483 A 3/1933 Ware, Jr.
1,925,102 A 9/1933 Levkoff
1,951,408 A 3/1934 Haven
2,027,079 A 1/1936 Weiss
2,126,106 A 8/1938 Goldberg
2,141,743 A 12/1938 Ethridge
2,145,430 A 1/1939 New
2,152,079 A 3/1939 Mott
2,196,243 A 4/1940 Bensel
2,290,971 A 7/1942 King
2,330,294 A 9/1943 Leavitt et al.
2,416,332 A 2/1947 Lehman
2,442,699 A 6/1948 Locke, Jr.
2,550,417 A * 4/1951 Klein ..... B65D 81/368 229/116.4
2,643,589 A 6/1953 Weiss
2,643,811 A * 6/1953 Bolding ..... B65D 5/4204 229/120.12
2,679,349 A 5/1954 Mullinix
2,710,134 A 6/1955 Schroeder et al.
2,791,362 A 5/1957 Nute
2,872,093 A 2/1959 Chaplin
2,875,938 A 3/1959 Bramhill
2,967,610 A 1/1961 Ebert et al.
3,002,613 A 10/1961 Merkel et al.
3,070,222 A 12/1962 Jones
3,090,483 A 5/1963 Algree et al.
3,157,342 A 11/1964 Grady
3,257,028 A 6/1966 Metzger
3,265,283 A 8/1966 Farquhar
3,276,665 A 10/1966 Rasmussen
3,276,667 A 10/1966 Johnson et al.
3,280,968 A 10/1966 Craine
3,389,850 A 6/1968 Rockefeller
3,428,235 A 2/1969 Randazzo
3,434,648 A 3/1969 Du Barry, Jr.
3,653,495 A 4/1972 Gray
3,677,458 A 7/1972 Gosling
3,679,093 A 7/1972 Chang
3,682,297 A * 8/1972 Austin ..... B65D 5/48014 206/387.11
3,721,339 A 3/1973 Seyer
3,759,378 A 9/1973 Werth
3,786,914 A 1/1974 Beutler
3,884,348 A 5/1975 Ross
4,008,849 A 2/1977 Baber
4,058,206 A 11/1977 Morse et al.
4,111,297 A 9/1978 Paulin
4,113,100 A 9/1978 Soja et al.
4,166,570 A 9/1979 Lazerand et al.
4,201,291 A 5/1980 Davidson
4,214,660 A 7/1980 Hunt, Jr.
4,286,399 A 9/1981 Funahashi et al.
4,363,081 A 12/1982 Wilbur
4,363,400 A 12/1982 Lewis
4,417,655 A 11/1983 Forbes, Jr.
4,424,897 A * 1/1984 Ondris ..... B65D 5/5016 206/782
4,497,126 A 2/1985 Dejean
4,519,538 A 5/1985 Omichi
4,558,785 A 12/1985 Gordon
4,586,643 A 5/1986 Halabisky et al.
4,607,747 A 8/1986 Steiner
4,637,515 A 1/1987 Wilson et al.
4,694,955 A 9/1987 Rank, Jr.
4,705,162 A 11/1987 Kupersmit
4,742,917 A 5/1988 Bornwasser et al.
4,756,408 A 7/1988 Grauf
4,760,952 A 8/1988 Wachter et al.
4,773,541 A 9/1988 Riddell
4,815,609 A 3/1989 Kiedaisch
4,865,187 A 9/1989 Zulauf et al.
4,886,160 A 12/1989 Kligerman
4,919,266 A 4/1990 McIntosh, Jr. et al.
4,930,637 A 6/1990 DeRoseau
5,005,701 A * 4/1991 Dutcher ..... B65D 5/5019 206/775
5,018,663 A 5/1991 Corso
5,060,852 A 10/1991 Beckerman et al.
5,063,698 A 11/1991 Johnson et al.
5,145,060 A 9/1992 Maye
5,147,129 A 9/1992 Ku
5,161,882 A 11/1992 Garrett
5,181,650 A 1/1993 Hollander et al.
5,217,286 A 6/1993 Ming-ho
5,243,504 A 9/1993 Sejzer
5,251,778 A 10/1993 Eggl
5,366,780 A 11/1994 Rapisarda
5,368,194 A 11/1994 Oliff et al.
5,375,700 A 12/1994 Joss et al.
5,379,886 A 1/1995 Brauner et al.
5,398,869 A 3/1995 Dickson et al.
5,400,229 A 3/1995 Lin
5,505,372 A 4/1996 Edson et al.
5,509,534 A 4/1996 Taravella et al.
5,520,325 A 5/1996 Quaintance
5,523,741 A 6/1996 Cane
5,551,556 A 9/1996 Sutherland
5,566,878 A 10/1996 Peiffer et al.
5,575,098 A 11/1996 Goettel-Schwartz
5,597,070 A 1/1997 Wu
5,607,058 A * 3/1997 Huesman ..... B65D 5/4204 206/581
5,690,213 A 11/1997 Matsumura
5,699,957 A 12/1997 Blin et al.
5,717,574 A 2/1998 Gustafson
5,722,583 A 3/1998 Focke et al.
5,730,353 A 3/1998 Holley, Jr.
5,752,597 A 5/1998 Brangle, Jr.
5,783,030 A 7/1998 Walsh
5,788,117 A 8/1998 Zimmanck
5,842,576 A 12/1998 Snow
5,857,570 A 1/1999 Brown
5,878,947 A 3/1999 Hoy et al.
5,881,884 A 3/1999 Podosek
D408,731 S 4/1999 Taylor et al.
5,907,944 A 6/1999 Giacoman
5,921,398 A 7/1999 Carroll
5,923,242 A 7/1999 Slagle et al.
5,927,498 A 7/1999 Saam
5,955,958 A 9/1999 Lu
5,979,749 A 11/1999 Bozich
5,980,062 A 11/1999 Bell
6,015,084 A 1/2000 Mathieu et al.
6,020,823 A 2/2000 DeCicco
D431,462 S 10/2000 Menaged et al.
6,129,211 A 10/2000 Prakken et al.
6,135,289 A 10/2000 Miller
6,145,665 A * 11/2000 Krahn ..... B65D 5/4208 206/449
6,158,579 A 12/2000 Rosenbaum
6,173,833 B1 1/2001 Strehlow
D438,791 S 3/2001 Tsuruishi et al.
D439,157 S 3/2001 Tsuruishi et al.
6,206,750 B1 3/2001 Barad et al.
D441,285 S 5/2001 Tsuruishi et al.
D441,643 S 5/2001 Tsuruishi et al.
6,237,777 B1 5/2001 Bierly
6,241,083 B1 6/2001 Harrelson
6,296,121 B1 10/2001 Hershey
6,298,990 B1 10/2001 Amrod et al.

(56) References Cited

U.S. PATENT DOCUMENTS

| | | | | |
|---|---|---|---|---|
| 6,318,882 | B1 | 11/2001 | Chang | |
| 6,371,365 | B1 | 4/2002 | Doucette et al. | |
| 6,386,369 | B2 | 5/2002 | Yuhas et al. | |
| 6,402,021 | B1 | 6/2002 | Heathcock | |
| 6,409,077 | B1 | 6/2002 | Telesca et al. | |
| 6,419,152 | B1 | 7/2002 | Tokarski | |
| 6,435,351 | B1 | 8/2002 | Gibb | |
| 6,435,403 | B1 | 8/2002 | Giblin et al. | |
| 6,470,653 | B1 | 10/2002 | Lutz et al. | |
| 6,474,539 | B1 | 11/2002 | Van Der Horst | |
| 6,478,159 | B1 | 11/2002 | Taylor et al. | |
| 6,510,982 | B2 | 1/2003 | White et al. | |
| 6,523,692 | B2 | 2/2003 | Gregory | |
| 6,568,828 | B2 | 5/2003 | Rudoy | |
| 6,573,880 | B1 | 6/2003 | Simoni et al. | |
| 6,631,803 | B2 | 10/2003 | Rhodes et al. | |
| 6,679,029 | B2 | 1/2004 | Clay | |
| 6,729,475 | B2 | 5/2004 | Yuhas et al. | |
| 6,755,306 | B2 | 6/2004 | Maus | |
| 6,771,165 | B2 | 8/2004 | Burg, II et al. | |
| 6,802,415 | B2 | 10/2004 | Loeffler | |
| 6,811,028 | B2 | 11/2004 | Kim et al. | |
| 6,823,988 | B2 | 11/2004 | Ryan et al. | |
| 6,854,639 | B2 | 2/2005 | Walsh | |
| 6,913,189 | B2 | 7/2005 | Oliff et al. | |
| 6,918,487 | B2 | 7/2005 | Harrelson | |
| 6,923,365 | B2 | 8/2005 | Auclair et al. | |
| 7,000,773 | B2 | 2/2006 | Hubbs et al. | |
| 7,004,897 | B2 | 2/2006 | Spivey, Sr. | |
| 7,021,468 | B2 | 4/2006 | Cargile, Jr. | |
| 7,064,498 | B2 | 6/2006 | Dowling et al. | |
| 7,086,751 | B2 | 8/2006 | Clark | |
| D532,685 | S | 11/2006 | Reussner | |
| 7,198,383 | B2 | 4/2007 | Martino | |
| 7,201,714 | B2 | 4/2007 | Zoeckler et al. | |
| 7,225,930 | B2 | 6/2007 | Ford et al. | |
| 7,258,265 | B2 | 8/2007 | Loew | |
| 7,284,662 | B2 | 10/2007 | DeBusk et al. | |
| 7,320,407 | B2 | 1/2008 | Hubbs et al. | |
| 7,328,834 | B2 | 2/2008 | Harrelson | |
| 7,546,924 | B2 * | 6/2009 | Oliveira | B65D 5/2009 206/763 |
| 7,581,644 | B2 | 9/2009 | Wright | |
| 7,584,854 | B2 | 9/2009 | Chandaria | |
| 7,614,497 | B2 | 11/2009 | Spivey, Sr. | |
| 7,628,746 | B2 | 12/2009 | Varanasi | |
| 7,658,317 | B2 | 2/2010 | Wilkins | |
| 7,703,665 | B2 | 4/2010 | McGowan | |
| 7,784,617 | B2 | 8/2010 | Urban | |
| 7,874,430 | B2 | 1/2011 | Anderson et al. | |
| 8,028,839 | B2 | 10/2011 | Learn | |
| 8,152,326 | B2 | 4/2012 | House et al. | |
| 8,328,079 | B2 | 12/2012 | Kohler | |
| 8,365,914 | B2 | 2/2013 | Learn | |
| 8,365,920 | B2 | 2/2013 | House et al. | |
| 8,499,999 | B2 * | 8/2013 | Sieber | B65D 5/4204 206/775 |
| 8,740,054 | B2 | 6/2014 | Pinkstone | |
| 9,211,971 | B2 | 12/2015 | Fogle et al. | |
| 2001/0000203 | A1 | 4/2001 | Yuhas et al. | |
| 2001/0001447 | A1 | 5/2001 | Gregory | |
| 2002/0043554 | A1 | 4/2002 | White et al. | |
| 2002/0048169 | A1 | 4/2002 | Dowling et al. | |
| 2002/0066778 | A1 | 6/2002 | Heeley et al. | |
| 2002/0070688 | A1 | 6/2002 | Dowling et al. | |
| 2002/0088730 | A1 | 7/2002 | Galomb | |
| 2002/0170845 | A1 | 11/2002 | Oliff | |
| 2003/0024848 | A1 | 2/2003 | Oycke | |
| 2003/0210141 | A1 | 11/2003 | Iacovino | |
| 2004/0032732 | A1 | 2/2004 | Rubin | |
| 2004/0099570 | A1 | 5/2004 | Cargile | |
| 2004/0104263 | A1 | 6/2004 | Keay et al. | |
| 2004/0150983 | A1 | 8/2004 | Sexton et al. | |
| 2004/0163986 | A1 | 8/2004 | Pinyot | |
| 2004/0264179 | A1 | 12/2004 | Clark | |
| 2005/0092649 | A1 | 5/2005 | Ford et al. | |
| 2005/0155905 | A1 | 7/2005 | Monk | |
| 2005/0167291 | A1 | 8/2005 | Sutherland | |
| 2005/0199690 | A1 | 9/2005 | Peterson | |
| 2005/0218203 | A1 | 10/2005 | Harrelson | |
| 2005/0237006 | A1 | 10/2005 | Lee | |
| 2005/0247767 | A1 | 11/2005 | Smalley | |
| 2006/0006096 | A1 | 1/2006 | Funk | |
| 2006/0012994 | A1 | 1/2006 | Martino | |
| 2006/0139928 | A1 | 6/2006 | Griffiths et al. | |
| 2006/0243739 | A1 | 11/2006 | Sherman et al. | |
| 2006/0254954 | A1 * | 11/2006 | Wright | B65D 5/5016 206/756 |
| 2006/0266815 | A1 | 11/2006 | Coltri-Johnson et al. | |
| 2007/0000934 | A1 | 1/2007 | Wolpow | |
| 2007/0121321 | A1 | 5/2007 | Cheng | |
| 2009/0014353 | A1 | 1/2009 | Lewis, Jr. et al. | |
| 2009/0314661 | A1 | 12/2009 | Fisher et al. | |
| 2010/0065618 | A1 | 3/2010 | Lechevalier et al. | |
| 2010/0270367 | A1 | 10/2010 | Brandenburger | |
| 2011/0101078 | A1 | 5/2011 | Requena et al. | |
| 2012/0037692 | A1 | 2/2012 | Fitzwater | |
| 2013/0221080 | A1 | 8/2013 | Spivey, Sr. et al. | |
| 2014/0332428 | A1 * | 11/2014 | Holley, Jr. | B65D 71/38 206/433 |

FOREIGN PATENT DOCUMENTS

| | | |
|---|---|---|
| DE | 2 98 17 195 | 11/1998 |
| DE | 202 16 854 | 1/2003 |
| EP | 0 133 595 | 2/1985 |
| EP | 0 465 257 | 1/1992 |
| EP | 0 704 386 | 4/1996 |
| EP | 1 864 913 | 12/2007 |
| EP | 2 308 762 | 4/2011 |
| FR | 1 379 931 | 11/1964 |
| FR | 2 853 886 | 10/2004 |
| FR | 2 882 032 | 8/2006 |
| GB | 1 218 016 | 1/1971 |
| GB | 2 238 776 | 6/1991 |
| JP | 02-025420 U | 2/1990 |
| JP | 03275438 | 12/1991 |
| JP | 2004-41613 | 2/2004 |
| JP | 2007-275086 | 10/2007 |
| JP | 2008-179381 A | 8/2008 |
| WO | WO 98/31593 | 7/1998 |
| WO | WO 03/082686 | 10/2003 |
| WO | WO 2004/063031 | 7/2004 |
| WO | WO 2005/110866 | 11/2005 |

* cited by examiner

CARTON WITH DISPLAY FEATURE

CROSS-REFERENCE TO RELATED APPLICATIONS

This application claims the benefit of U.S. Provisional Patent Application No. 62/239,415 filed Oct. 9, 2015.

INCORPORATION BY REFERENCE

The disclosure of U.S. Provisional Patent Application No. 62/239,415 filed Oct. 9, 2015, is hereby incorporated by reference for all purposes as if presented herein in its entirety.

BACKGROUND OF THE DISCLOSURE

The present disclosure generally relates to cartons for holding beverage containers or other types of articles. More specifically, the present disclosure relates to cartons having a display feature.

SUMMARY OF THE DISCLOSURE

In general, one aspect of the disclosure is directed to a carton for holding a plurality of articles. The carton comprises a plurality of panels that extends at least partially around an interior of the carton. The plurality of panels comprises a top panel, a bottom panel, a first side panel, and a second side panel. The carton comprises a display feature comprising a display opening in at least one of the first side panel and the second side panel, and a display panel foldably connected to the top panel. The display panel is located in the interior and spaced-apart from the opening. The display panel is at least partially visible through the display opening.

In another aspect, the disclosure is generally directed to a blank for forming a carton for holding a plurality of articles. The blank comprising a plurality of panels comprising a top panel, a bottom panel, a first side panel, and a second side panel. The plurality of panels being for forming an interior of the carton formed from the blank. The blank comprises a display feature comprising a display opening in at least one of the first side panel and the second side panel, and a display panel foldably connected to the top panel. The display panel is for being located in the interior and spaced-apart from the opening and positioned for being at least partially visible through the display opening in the carton formed from the blank.

In another aspect, the disclosure is generally directed to a method of forming a carton for holding a plurality of articles. The method comprises obtaining a blank having a plurality of panels comprising a top panel, a bottom panel, a first side panel, and a second side panel. The blank comprises a display feature comprising a display opening in at least one of the first side panel and the second side panel, and a display panel foldably connected to the top panel. The method comprises positioning the plurality of panels to extend at least partially around an interior of the carton, and positioning the display panel to be located in the interior and spaced-apart from the display opening so that the display panel is at least partially visible through the display opening.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENT

The present disclosure generally relates to cartons that hold and contain articles such as containers, bottles, cans, etc. The articles can be used for packaging beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "inner," "outer," "lower," "bottom," "upper," and "top" indicate orientations determined in relation to fully erected and upright cartons.

Figure 1:
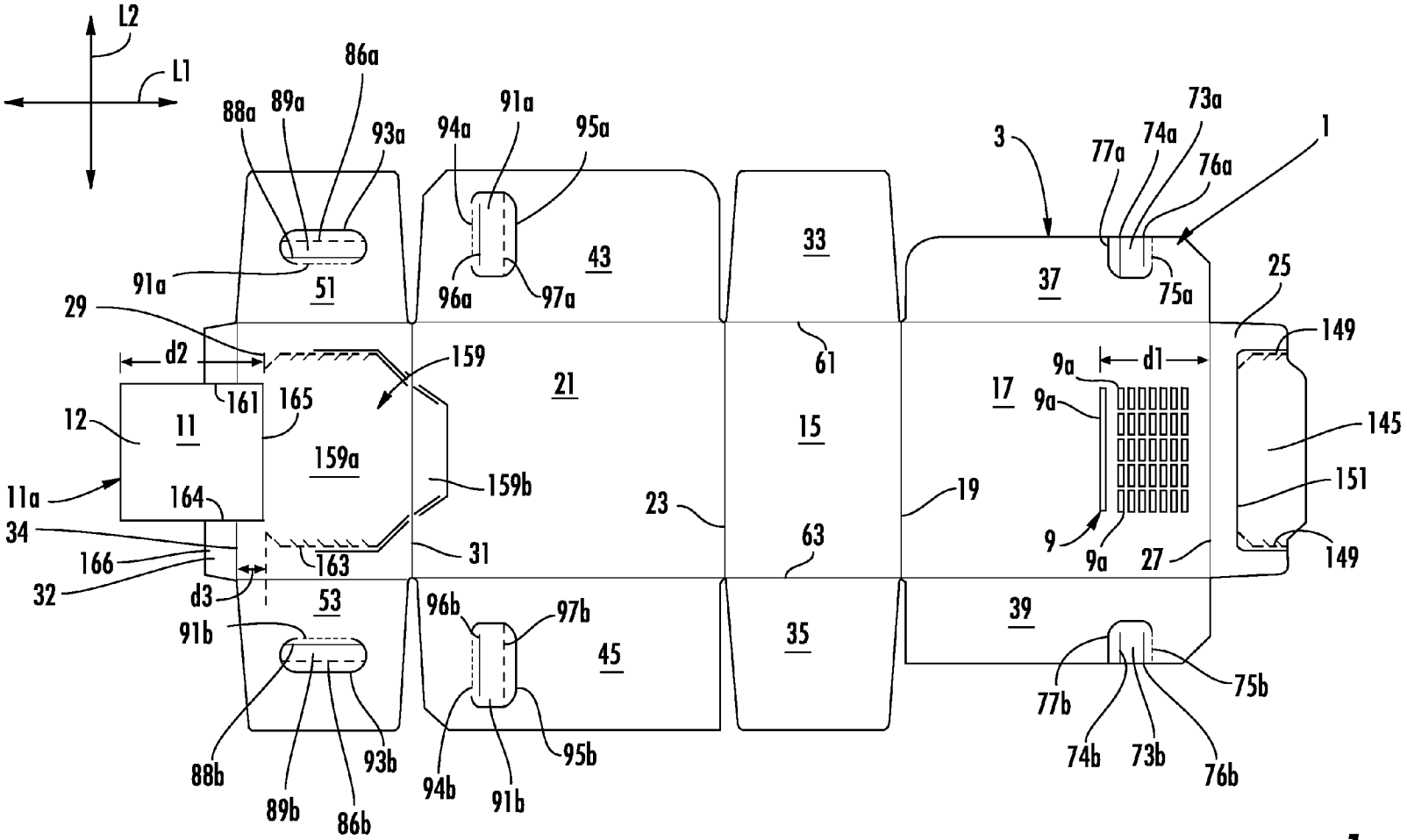
FIG. 1 is a plan view of a blank for forming a carton according to a first embodiment of the disclosure.
Figure 2:
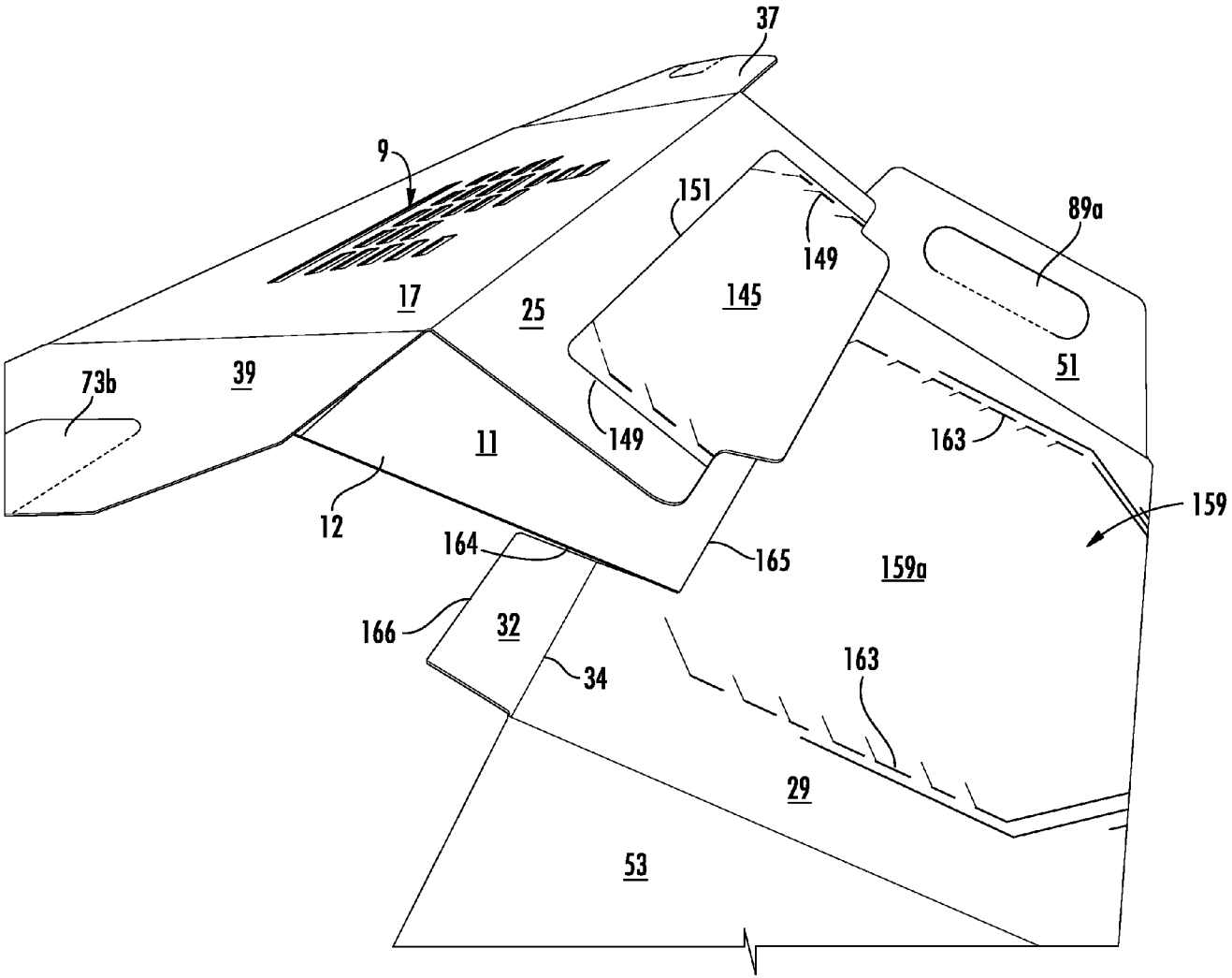
FIG. 2 is a perspective view of the blank of FIG. 1 in a partially erected state according to the first embodiment of the disclosure.
Figure 3:
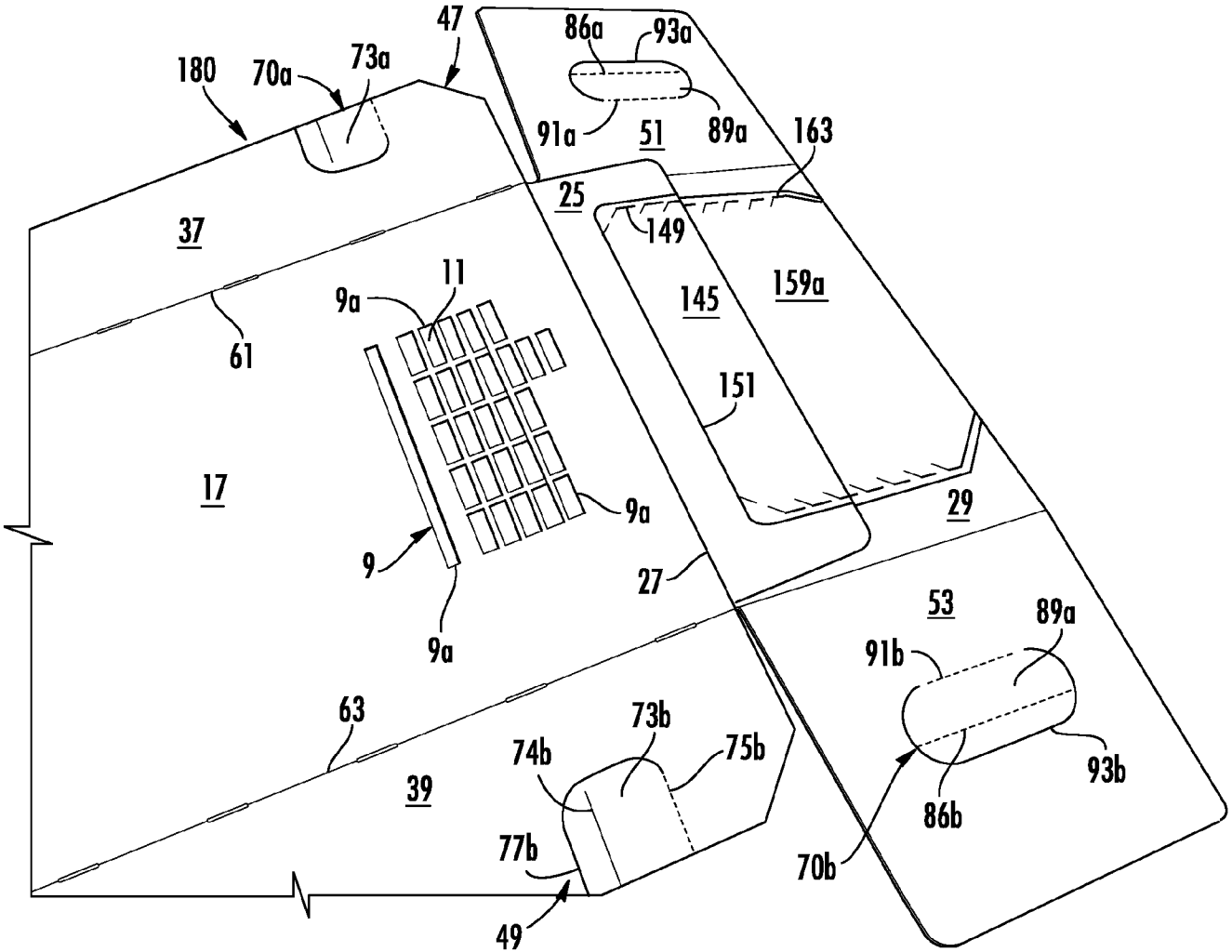
FIG. 3 is a perspective view of the blank of FIG. 1 in a further partially erected state.

FIG. 1 is a plan view of the exterior side 1 of a blank, generally indicated at 3, used to form a carton 5 (FIG. 4) according to the exemplary embodiment of the disclosure. The carton 5 can be used to hold a plurality of articles such as containers (not shown) that can be beverage bottles or any other suitable container. In the illustrated embodiment, the carton 5 is sized to house six containers in a single layer in a 2×3 arrangement, but it is understood that the carton 5 may be sized and shaped to hold containers of a different or same quantity in more than one layer and/or in different row/column arrangements (e.g., 1×6, 3×4, 3×6, 3×5, 2×6×2, 3×4×2, 2×9, 2×6, 4×6, etc.). In the illustrated embodiment, the carton 5 includes display features 7 that comprise a cutout or display opening, generally indicated at 9 (FIG. 1), and a display panel 11 recessed behind and spaced-apart from the display opening 9 for providing a background image and a three dimensional window effect. As will be discussed below in more detail, the display features 7 are formed from various features in the blank 3.

The carton blank 3 has a longitudinal axis L1 and a lateral axis L2. In the embodiment of FIG. 1, the blank includes a bottom panel 15 foldably connected to a first side panel 17 at a lateral fold line 19. A second side panel 21 is foldably connected to the bottom panel 15 at a lateral fold line 23. A first top panel 25 is foldably connected to the first side panel 17 at a lateral fold line 27, and a second top panel 29 is foldably connected to the second side panel 21 at a lateral fold line 31. An attachment panel 32 is foldably connected to the second top panel 29 at a lateral fold line 34. Any of the top and bottom panels 25, 29, 15 and the first and second side panels 17, 21 can be otherwise shaped, arranged, configured, or omitted, without departing from the disclosure. In one embodiment, the first top panel 25 overlaps the second top panel 29 to form a top wall 14 (FIG. 4) of the carton 5.

The bottom panel 15 is foldably connected to a first bottom end flap 33 and a second bottom end flap 35. The first side panel 17 is foldably connected to a first side end flap 37 and a second side end flap 39. The second side panel 21 is foldably connected to a first side end flap 43 and a second side end flap 45. The second top panel 29 is foldably connected to a first top end flap 51 and a second top end flap 53. In one embodiment, when the carton 5 is erected, the end flaps 33, 37, 43, 51 close the first end 47 of the carton, and the end flaps 35, 39, 45, 53 close the second end 49 of the carton. In accordance with an alternative embodiment of the present disclosure, different flap arrangements can be used for closing the ends 47, 49 of the carton 5. In accordance with an alternative embodiment of the present disclosure, different flap arrangements can be used for closing the first end 47 and the second end 49 of the carton 5.

The end flaps 33, 37, 43, 51 extend along a first marginal area of the blank 3, and are foldably connected at a first longitudinal fold line 61 that extends along the length of the blank. The end flaps 35, 39, 45, 53 extend along a second marginal area of the carton blank 3, and are foldably connected at a second longitudinal fold line 63 that also extends along the length of the blank. The longitudinal fold lines 61, 63 may be, for example, substantially straight, curved, or offset at one or more locations to account for blank thickness or for other factors. The ends of the carton 5 could be otherwise shaped, arranged, and/or configured (e.g., at least partially tapered) without departing from the disclosure.

In the embodiment of FIG. 1, the carton blank 3 has handle features for forming the handles 70*a*, 70*b*. The handle features comprise handle flaps 73*a*, 73*b* each foldably connected to a respective side end flap 37, 39 at respective fold lines 75*a*, 75*b* and separable from the respective top end flap 37, 39 along respective cut lines 77*a*, 77*b*. The handle flaps 73*a* and 73*b* have two respective parallel fold lines 74*a*, 76*a* and 74*b*, 76*b*. In one embodiment, the fold lines 74*a*, 76*a* and 74*b*, 76*b* can be cut-crease lines; however, the fold lines could be otherwise configured (e.g., scores, creases, perforations, etc.).

As shown in FIG. 1, the handle features further include handle flaps 89*a*, 89*b* defined in the respective top end flaps 51, 53. Each of the handle flaps 89*a*, 89*b* is foldably connected to the respective top end flap 51, 53 along respective fold lines 91*a*, 91*b* and is separable from the respective top end flap along cut lines 93*a*, 93*b*. In one embodiment, the handle flaps 89*a*, 89*b* have two respective parallel fold lines 86*a*, 88*a* and 86*b*, 88*b*. In one embodiment, the handle features further can include handle flaps 91*a*, 91*b* defined in one or more of the respective side end flaps 43, 45. Each of the handle flaps 91*a*, 91*b* is foldably connected to the respective top end flap 43, 45 along respective fold lines 94*a*, 94*b* and is separable from the respective top end flap along cut lines 95*a*, 95*b*. In one embodiment, the handle flaps 91*a*, 91*b* have two respective parallel fold lines 96*a*, 97*a* and 96*b*, 97*b*.

The blank 3 can have other features for forming the handles 70*a*, 70*b*, or the blank 3 and/or carton 5 can have one or more handles that are alternatively shaped, arranged, and/or configured without departing from the disclosure. For example, any or all of the handle flaps 73*a*, 73*b*, 89*a*, 89*b*, 91*a*, 91*b* could be omitted. Further, one or both of the handles 70*a*, 70*b* can be omitted without departing from the disclosure.

Figure 4:
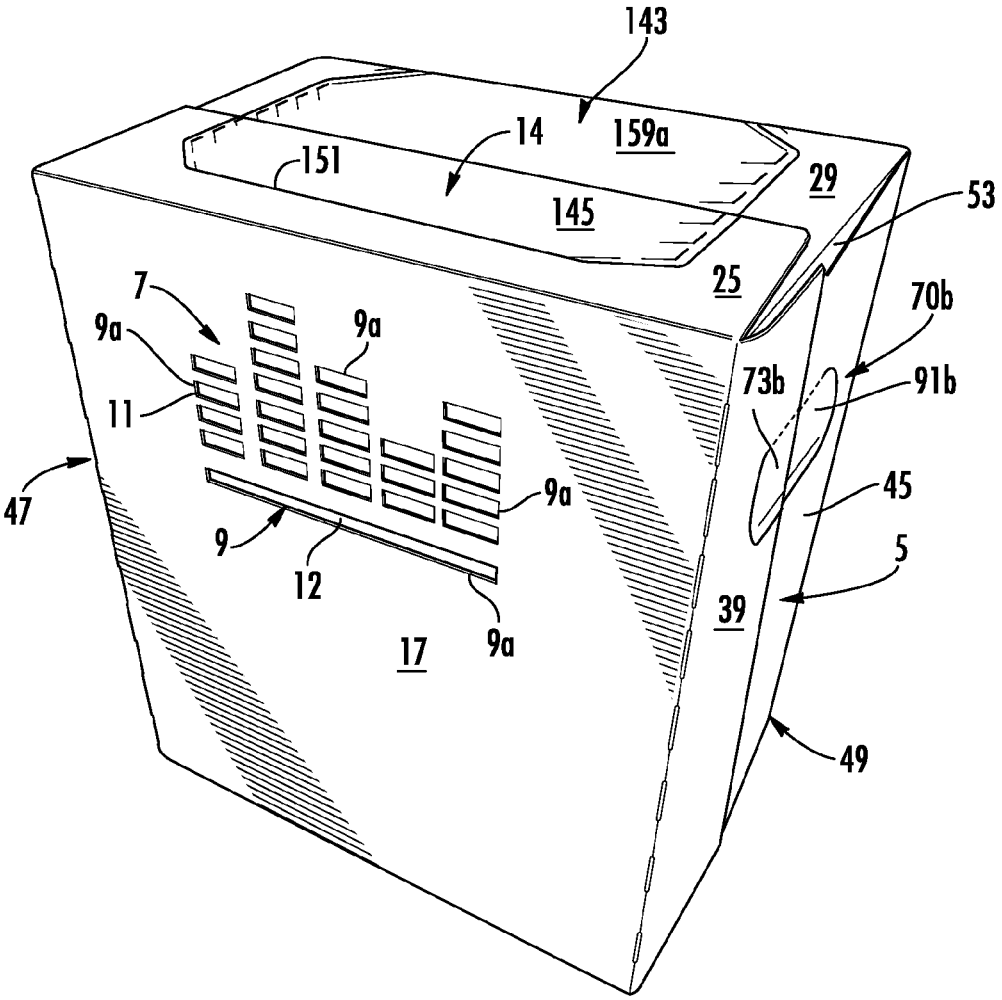
FIG. 4 is a perspective view of the carton according to the first embodiment of the disclosure.

As shown in FIG. 1, the blank 3 includes dispenser features or opening features for forming a dispenser 143 in the carton 5 (FIG. 4). The dispenser features include a first dispenser panel 145 formed in the first top panel 25. The first dispenser panel 145 is separable from the remainder of the first top panel 25 along tear lines 149 and is foldably connected to the first top panel 25 along a respective longitudinal fold line 151. In one embodiment, the tear lines 149 extend from respective ends of the fold line 151 but, the first dispenser panel 145 and/or the tear lines 149 and fold line 151 could be otherwise shaped, arranged, and/or configured without departing from the disclosure.

In the illustrated embodiment, the dispenser features in the blank 3 further include a second dispenser panel 159 having a first portion 159*a* in the top panel 29 and a second portion 159*b* in the second side panel 21. The second dispenser panel 159 is separable from the remainder of the second top panel 29 and second side panel 21 along tear lines 163 and is foldably connected to the display panel 11 along lateral fold line 165. The tear lines 163 can be shaped and disposed in the second top panel 29 and second side panel 21 so that, when the carton 5 is formed, the first top panel 25 overlaps a portion of the second top panel 29 with the first dispenser panel 145 overlapping a portion of the second dispenser panel 159 so that the tear lines 163 are generally aligned with the tear lines 149. The second dispenser panel 159, and/or tear lines 163 and fold line 165 could be otherwise shaped, arranged, and/or configured without departing from the disclosure. Additionally, one or both the dispenser panels 145, 159 could be otherwise shaped, arranged, configured, and/or omitted without departing from the disclosure.

In one embodiment, the cutout 9 is located in the first side panel 17 and may extend a longitudinal distance "d1" from the fold line 27. The cutout 9 may be any suitable shape and/or artistic design such as multiple smaller openings such as rectangles, circles, letters, numbers, logo, openings having curved edges, etc., or any other design or combination thereof. In the embodiment of FIG. 1, the cutout 9 includes a plurality of rectangular openings 9*a*. Further, the cutout 9 can be a single opening having any shape or have an alternative shape or arrangement without departing from the disclosure.

As shown in FIG. 1, the display panel 11 is foldably connected to the top panel 29 at the fold line 165 that is adjacent to and at least partially defines the first portion 159*a* of the dispenser panel 159. In one embodiment, the display panel 11 is defined by two longitudinal cuts 161, 164 that extend from a respective end of the lateral fold line 165 to an edge 166 of the adhesive flap 32. The display panel 11 has a free edge 11*a* that is spaced-apart from the edge 166 of the adhesive flap. In the illustrated embodiment, the free edge 11*a* of the display panel 11 comprises a lateral edge at the longitudinal end of the blank 3. As illustrated in FIG. 1, the display panel 11 may have a longitudinal length "d2" extending from the fold line 165 to the free edge 11*a* of the display panel. In one embodiment the length "d2" is greater than the distance "d1" such that when the blank is formed into a carton the display panel 11 extends below the bottom of the cutout 9.

Figure 4A:
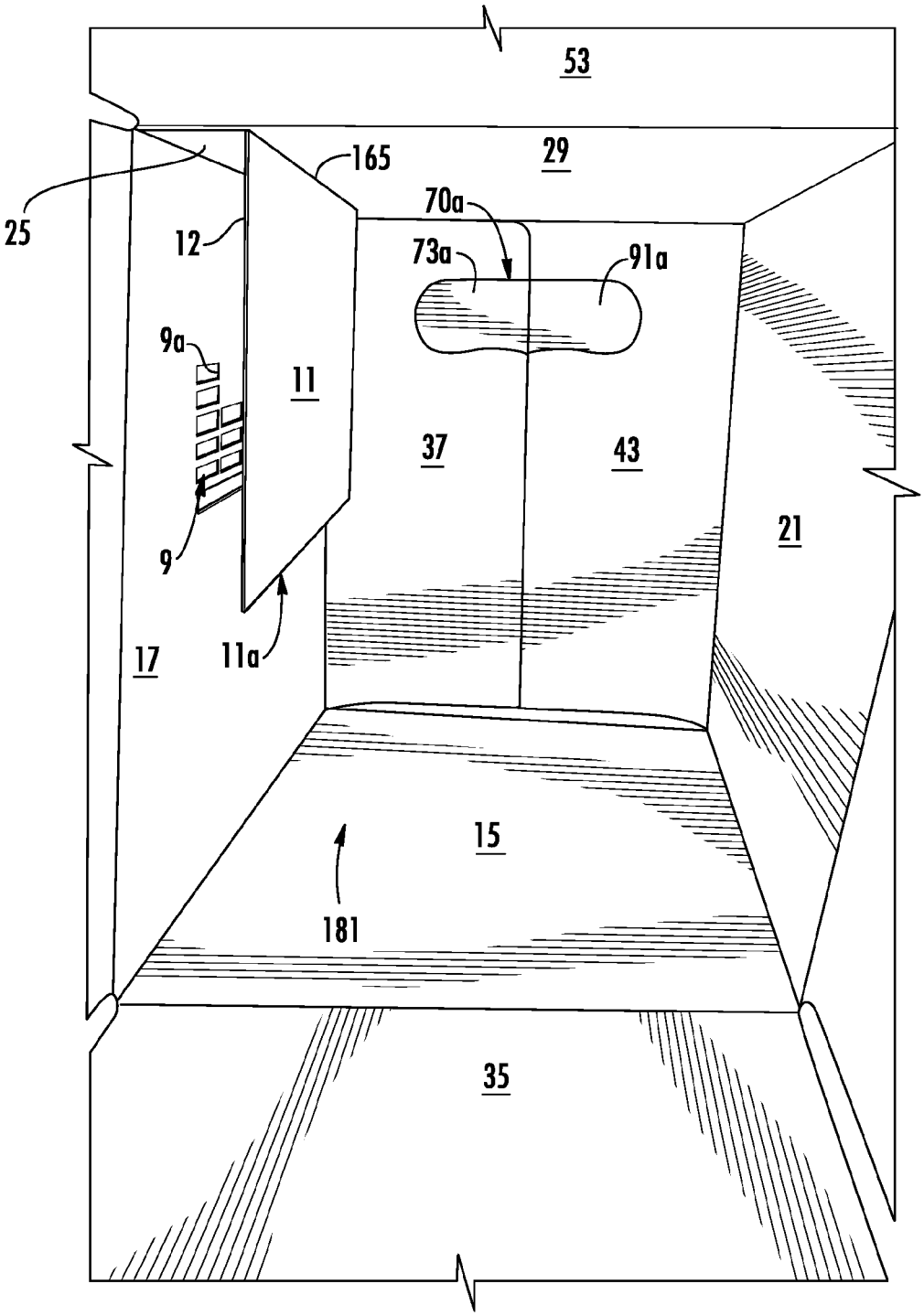
FIG. 4A, is a perspective view of the interior space of the carton of FIG. 4.

As illustrated in FIGS. 2-4A, in one exemplary method of forming the carton 5 from the blank, the carton can be formed by folding the blank along the transverse fold line 31 so that the second top panel 29 overlaps the interior surface of the second side panel 21 and folding the blank along the transverse fold line 19 so that the first top panel 25 at least partially overlaps the second top panel 29 to form the top wall 14 and the cutout 9 overlaps the display panel 11. Alternatively, the blank 3 could be folded along the transverse fold lines 23, 27 so that the first top panel 25 overlaps the second top panel 29. The first top panel 25 can be glued to the exterior of second top panel 29, and the attachment panel 32 can be glued to the first side panel 17 to form a sleeve 180 in the flat configuration. As shown in FIG. 4A, the sleeve 180 can be formed such that the bottom panel 15, side panels 17, 21, and top wall 14 comprising the overlapped top panel 25, 29 form an interior space 181 of the carton 5.

The blank can be folded along fold lines 19, 23, 27, 31 to form the sleeve 180 in an open configuration with the interior 181 formed. As shown in FIG. 4A, the display panel 11 may be folded along fold line 165 to at least partially position the display panel in the interior 181 of the carton in a spaced-apart arrangement from the side panel 17 and extending downwardly from the top wall 14. In one embodiment, the display panel 11 will be spaced apart from the cutout 9 in the side panel 17 by a distance d3 equal to the spacing between the fold lines 165, 34. The containers can be loaded into the interior 181 of the open-ended sleeve 180 before or after closing either of the ends 47, 49. The blank 3 may be otherwise formed into the open-ended sleeve using alternative folding and gluing steps without departing from the scope of this disclosure.

In the illustrated embodiment, the end flaps 33, 51 are inwardly folded along the longitudinal fold line 61 and the side end flaps 37, 43 are inwardly folded along the longitudinal fold line 61 to at least partially close the first end 47. In one embodiment, the side end flaps 37, 43 are glued in face-to face contact with the end flaps 51, 33. Accordingly, the handle 70*a* in the first end 47 is formed by the alignment of the handle flaps 73*a*, 89*a*, 91*a*. The top end flap 51, the side end flaps 37, 43, and the bottom end flap 33 can be selectively adhered to one another to close the first end 47 of the carton 5. In one embodiment, the handle flap 89*a* is glued to the respective handle flaps 73*a*, 91*a* to form a respective handle 70*a* at the first end 47.

In one embodiment, the second end 49 of the carton 5 can be closed in a similar manner as the first end 47 by folding, respectively overlapping, and selectively adhering the side end flaps 39, 45, the top end flap 153, and the bottom end flap 35. Further, the second handle 70*b* can be formed in a similar manner as the first handle 70*a*. The erected carton is shown in FIG. 4. One or both of the ends 47, 49 could be otherwise shaped, arranged, configured, or omitted, without departing from the disclosure. Additionally, the open-ended sleeve 180 can be alternatively loaded with containers and closed without departing from the disclosure. For example, the ends 47, 49 can be closed in any order, and the containers could be loaded before or after closing either or both of the ends 47, 49. As shown in FIG. 4A, the display panel 11 is generally in a parallel spaced apart plane as the side panel 17 so that any indicia printed on the exterior surface 12 of the display panel is visible through the openings 9 when the carton 5 is viewed from the exterior. The display panel 11 is spaced apart from the openings 9 in the side panel 17 so that the indicia printed on the exterior surface 12 of the display panel can have a three-dimensional effect in that the exterior surface 12 of the display panel is not directly in contact with the side panel 17 so that the exterior surface 12 of the display panel is space-apart from the openings. Alternatively, the display panel 11 could be at an oblique angle relative to the side panel 17.

Figure 5:
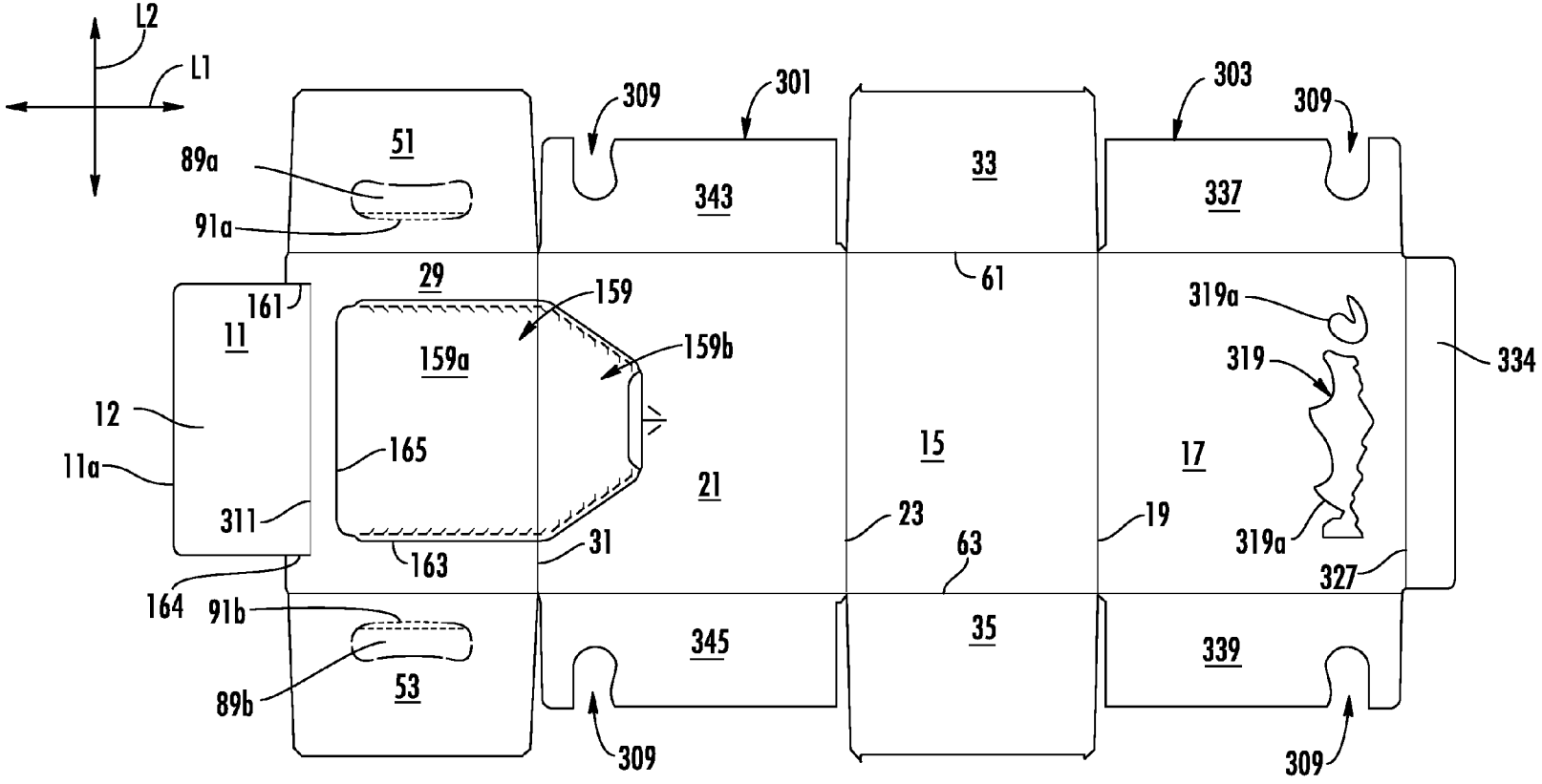
FIG. 5 is a plan view of a blank for forming a carton according to a second embodiment of the disclosure.
Figure 6:
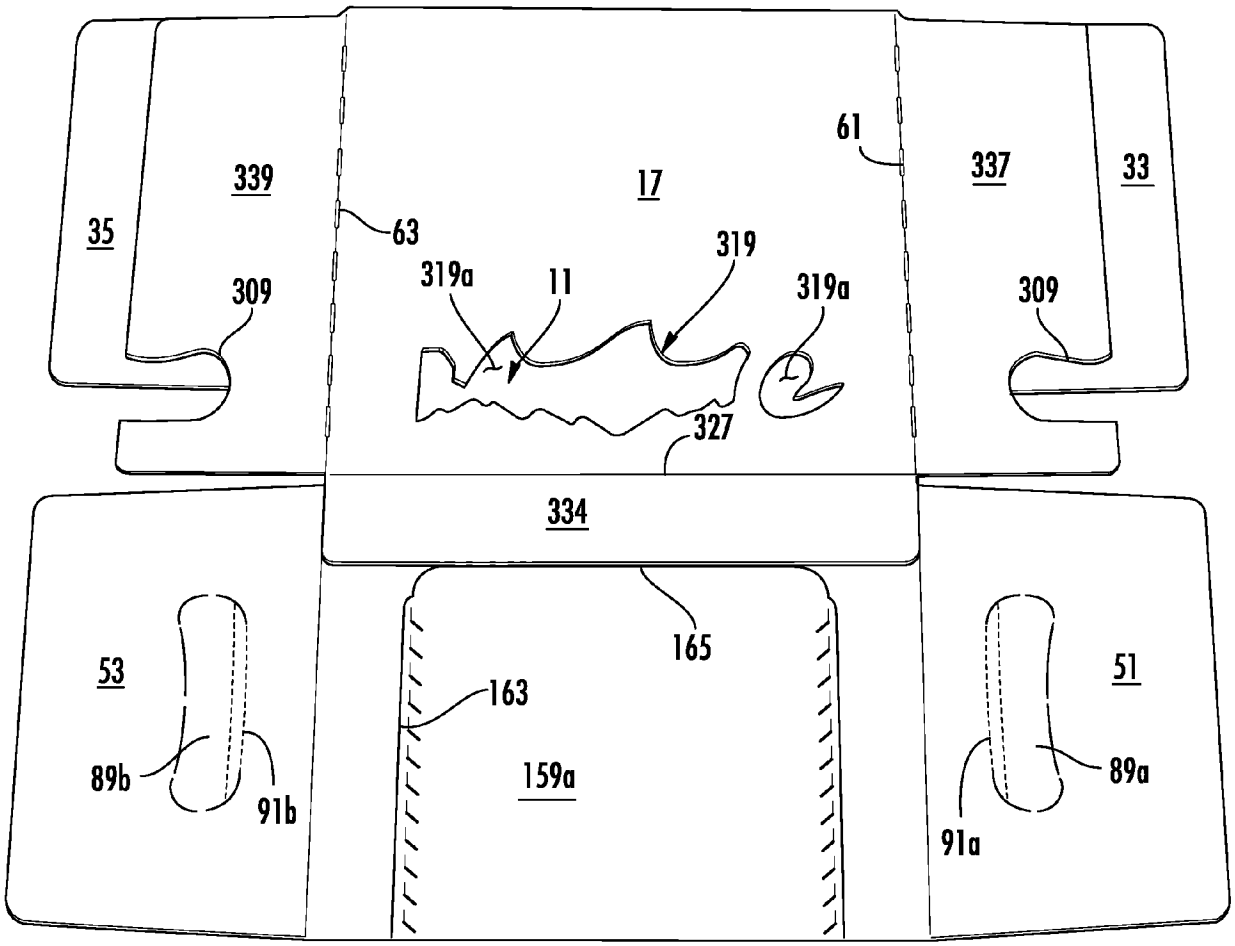
FIG. 6 is a perspective view of the blank of FIG. 5 in a partially erected state.
Figure 8:
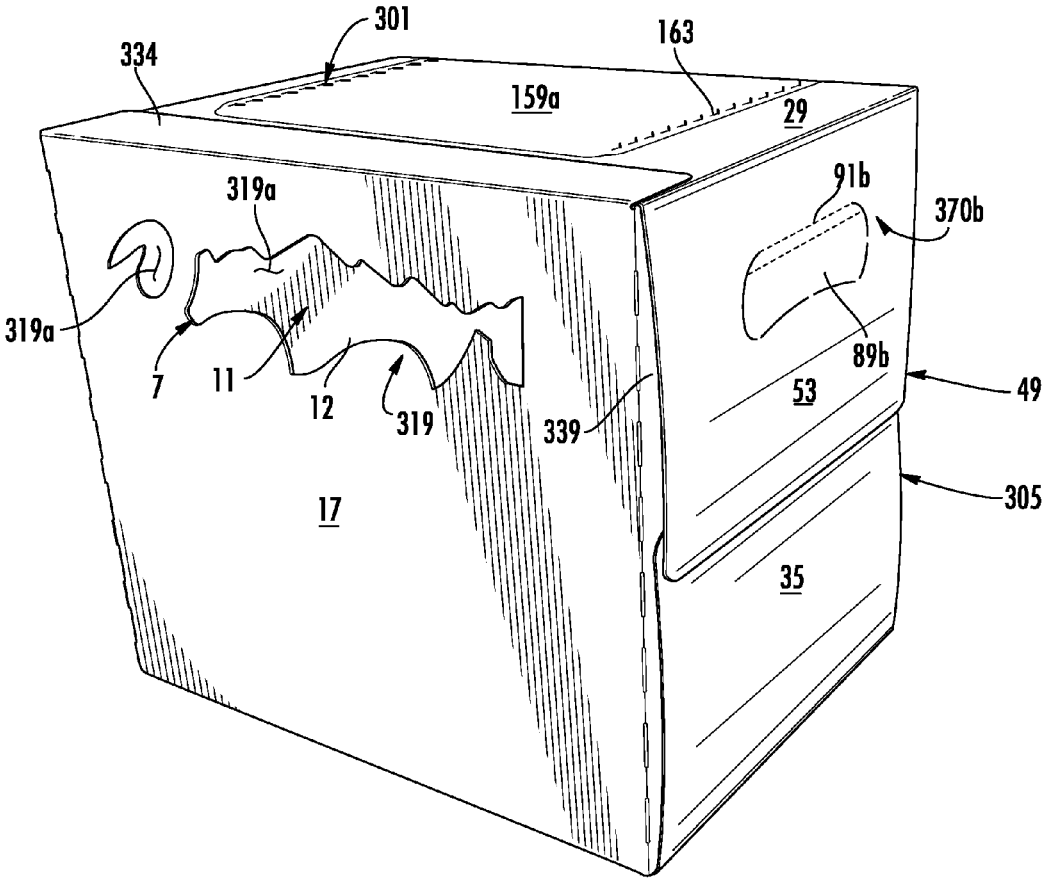
FIG. 8 is a perspective view of the carton according to the second embodiment of the disclosure.

FIG. 5 is a plan view of an exterior surface 301 of an alternative blank 303 for forming a carton 305 (FIG. 8) according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers.

As shown in FIG. 5, the blank 303 includes a bottom panel 15 foldably connected to a first side panel 17 at a lateral fold line 19. A second side panel 21 is foldably connected to the bottom panel 15 at a lateral fold line 23. A top panel 29 is foldably connected to the second side panel 21 at a lateral fold line 31. An attachment panel 334 is foldably connected to the first side panel 17 at a lateral fold line 327.

In one embodiment, the bottom panel 15 is foldably connected to a first bottom end flap 33 and a second bottom end flap 35. The first side panel 17 is foldably connected to a first side end flap 337 and a second side end flap 339. The second side panel 21 is foldably connected to a first side end flap 343 and a second side end flap 345. The top panel 29 is foldably connected to a first top end flap 51 and a second top end flap 53. In one embodiment, when the carton 305 is erected, the end flaps 33, 337, 343, 51 close the first end 347 of the carton, and the end flaps 35, 339, 345, 353 close the second end 309 of the carton.

The end flaps 33, 337, 343, 51 extend along a first marginal area of the blank 303, and are foldably connected at a first longitudinal fold line 61 that extends along the length of the blank. The end flaps 35, 339, 345, 349, 53 extend along a second marginal area of the carton blank 303, and are foldably connected at a second longitudinal fold line 63 that also extends along the length of the blank.

As illustrated in FIG. 5, the blank 303 includes handle openings or notches 309 in the end flaps 337, 339, 343, 345. The handle openings 309 cooperate to provide an opening at a respective closed end 347, 349 to allow a respective handle flap 89*a* and 89*b* to be inwardly folded at a respective end. The blank 303 can have other features for forming the handles 370*a*, 370*b*, or the blank 303 and/or carton 305 can have one or more handles that are alternatively shaped, arranged, and/or configured without departing from the disclosure. For example, any or all of the handle flaps 89*a*, 89*b* and handle features could be omitted.

In one embodiment, the blank 303 includes display features for forming a three dimensional display in the carton 305. As shown in FIG. 5, the display features include a cutout 319 in the form of two openings 319*a* in the first side panel 17 and a display panel 11 foldably connected to the top panel 29 at lateral fold line 311. As shown in FIG. 5, the fold line 311 is spaced apart from the fold line 165 connecting the dispenser panel 159*a* to the top panel 29. Also, the display panel 11 includes cuts 161, 164 that extend from respective ends of the fold line 165 and define the display panel 11. The display features of the second embodiment could be generally similar to the display features of the first embodiment, and the display features can be otherwise shaped, arranged, and/or configured without departing from the disclosure.

Figure 7:
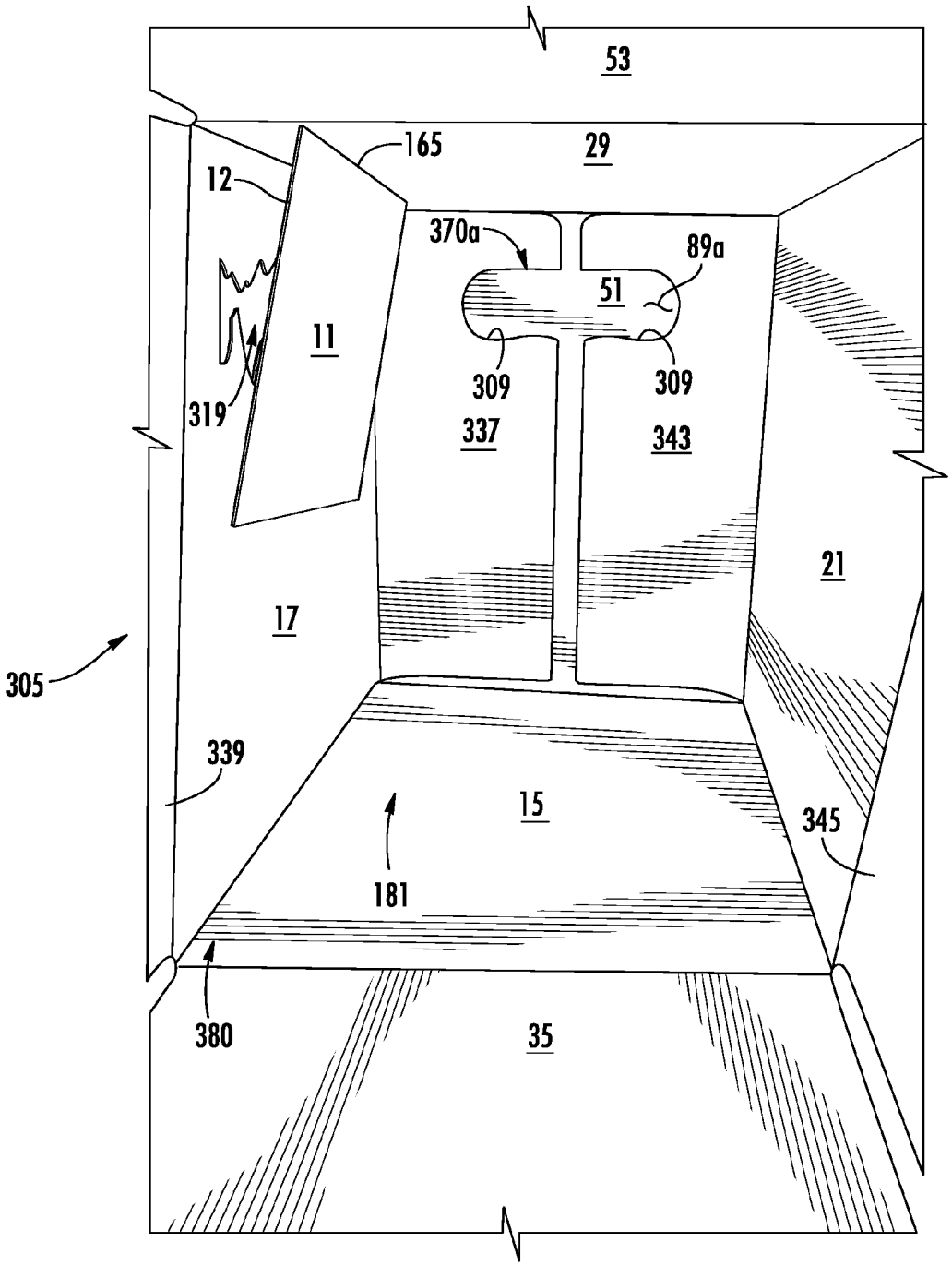
FIG. 7 is a perspective view of the interior space of the carton according to the second embodiment of the disclosure.

The blank 303 can be formed into the carton 305 in a similar manner as described above for the first embodiment. The blank 303 can be formed into an open-ended sleeve 380 (FIG. 7) by folding along the transverse fold lines 19, 23, 31, 327 and gluing the attachment panel 334 to the exterior surface of the top panel 29. The carton 305 can be erected generally similarly to the formation of the carton 5 of the first embodiment described above such that panels 15, 17, 21, 29 are positioned to form the interior space 181 of the carton 305. As shown in FIG. 7, the display panel 11 extends downwardly from the top panel 29 at the fold line 165 and is spaced apart from the first side panel 17. In one embodiment, the display panel 11 is generally oblique relative to the side panel 17, but the display panel could be otherwise positioned without departing from the disclosure. As with the first embodiment, the display panel 11 is positioned to be visible through the display openings 319, 319*a* when viewed from the exterior of the carton 305. The spacing of the display panel 11 from the display openings 319, 319*a* in the side panel 17 provides a three-dimensional affect of any graphics on the exterior surface 12 of the display panel 11 that are visible through the display openings in the side panel.

The blank 303 and/or carton 305 could be otherwise shaped, arranged, and/or configured without departing from the disclosure.

Any of the features of the various embodiments of the disclosure can be combined with, replaced by, or otherwise configured with other features of other embodiments of the disclosure without departing from the scope of this disclosure.

The blanks 3 and 303 according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blanks. In accordance with the above-described embodiments, the blank may be constructed of paperboard of a caliper such that it is heavier and more rigid than ordinary paper. The blanks can also be constructed of other materials, such as cardboard, hard paper, or any other material having properties suitable for enabling the cartons 5 and 305 to function at least generally as described herein. The blank can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of articles, the carton comprising:

a plurality of panels that extends at least partially around an interior of the carton, the plurality of panels comprising a top panel, a bottom panel, a first side panel, and a second side panel;

a display feature, the display feature comprising a display opening in at least one of the first side panel and the second side panel, and a display panel foldably connected to the top panel at a fold line, the display panel being located in the interior and spaced-apart from the opening, the display panel has an edge free from connection to the plurality of panels and is defined by at least two cuts in the top panel, each cut extending from a respective end of the fold line and extending to an edge of the top panel, the display panel is at least partially visible through the display opening.

2. The carton of claim 1, wherein the top panel comprises a first top panel foldably connected to the first side panel and a second top panel foldably connected to the second side panel, the display panel is foldably connected to the second top panel.

3. The carton of claim 2, wherein the first top panel overlaps the second top panel and forms a top wall of the carton.

4. The carton of claim 3, further comprising a dispenser comprising a first dispenser panel in the first top panel and a second dispenser panel in the second top panel.

5. The carton of claim 4, wherein the second dispenser panel extends into at least a portion of the second side panel.

6. The carton of claim 4, wherein the fold line is adjacent the second dispenser panel.

7. The carton of claim 6, wherein the second dispenser panel is at least partially defined by a tear line extending from the fold line.

8. The carton of claim 1, wherein the display panel is in a generally parallel to the first side panel.

9. The carton of claim 1, wherein the display panel is generally oblique relative to the first side panel.

10. The carton of claim 1, wherein the display opening comprises a plurality of openings.

11. The carton of claim 10, wherein the plurality of openings comprises a plurality of rectangular openings.

12. The carton of claim 1, further comprising a plurality of end flaps respectively foldably connected to a respective panel of the plurality of panels, the plurality of end flaps being at least partially overlapped for closing a closed end of the carton.

13. The carton of claim 12, further comprising a handle in the closed end of the carton, the handle having handle features in at least one of the plurality of end flaps.

14. A blank for forming a carton for holding a plurality of articles, the blank comprising:

a plurality of panels comprising a top panel, a bottom panel, a first side panel, and a second side panel, the plurality of panels being for forming an interior of the carton formed from the blank;

a display feature, the display feature comprising a display opening in at least one of the first side panel and the second side panel, and a display panel foldably connected to the top panel at a fold line, the display panel has an edge free from connection to the plurality of panels and is defined by at least two cuts in the top panel, each cut extending from a respective end of the fold line and extending to an edge of the top panel, the display panel is for being located in the interior and spaced-apart from the opening and positioned for being at least partially visible through the display opening in the carton formed from the blank.

15. The blank of claim 14, wherein the top panel comprises a first top panel foldably connected to the first side panel and a second top panel foldably connected to the second side panel, the display panel is foldably connected to the second top panel.

16. The blank of claim 15, further comprising dispenser features for forming a dispenser in the carton formed from the blank, the dispenser features comprising a first dispenser panel in the first top panel and a second dispenser panel in the second top panel.

17. The blank of claim 16, wherein the second dispenser panel extends into at least a portion of the second side panel.

18. The blank of claim 16, wherein the fold line is adjacent the second dispenser panel.

19. The blank of claim 18, wherein the second dispenser panel is at least partially defined by a tear line extending from the fold line.

20. The blank of claim 14, wherein the display opening comprises a plurality of openings.

21. The blank of claim 20, wherein the plurality of openings comprises a plurality of rectangular openings.

22. The blank of claim 14, further comprising a plurality of end flaps respectively foldably connected to a respective panel of the plurality of panels, the plurality of end flaps for being at least partially overlapped and forming a closed end of the carton formed from the blank.

23. The blank of claim 22, further comprising handle features for forming a handle in the closed end of the carton formed from the blank, the handle features are in at least one of the plurality of end flaps.

24. A method of forming a carton for holding a plurality of articles, the method comprising:

obtaining a blank having a plurality of panels comprising a top panel, a bottom panel, a first side panel, and a second side panel, a display feature comprising a display opening in at least one of the first side panel and the second side panel, and a display panel foldably connected to the top panel at a fold line, the display panel has an edge free from connection to the plurality of panels and is defined by at least two cuts in the top panel, each cut extending from a respective end of the fold line and extending to an edge of the top panel;

positioning the plurality of panels to extend at least partially around an interior of the carton; and positioning the display panel to be located in the interior and spaced-apart from the display opening so that the display panel is at least partially visible through the display opening.

25. The method of claim 24, wherein the top panel comprises a first top panel foldably connected to the first side panel and a second top panel foldably connected to the second side panel, the display panel is foldably connected to the second top panel, and the positioning the plurality of panels comprises positioning the first top panel to overlap the second top panel and form a top wall of the carton.

26. The method of claim 25, wherein the blank comprises dispenser features comprising a first dispenser panel in the first top panel and a second dispenser panel in the second top panel, and the method comprises forming a dispenser for accessing articles in the carton.

27. The method of claim 26, further comprising activating the dispenser by at least partially separating the first dispenser panel from the first top panel and at least partially separating the second dispenser panel from the second top panel to form an access opening for accessing the articles in the carton.

28. The method of claim 24, wherein the positioning the display panel comprises positioning the display panel to be generally parallel to the first side panel.

29. The method of claim 24, wherein the positioning the display panel comprises positioning the display panel to be generally oblique relative to the first side panel.

30. The method of claim 24, further comprising a plurality of end flaps respectively foldably connected to a respective panel of the plurality of panels, the method comprising closing end of the carton by positioning the plurality of end flaps to be at least partially overlapped.

31. The method of claim 30, wherein the blank comprises handle features in the plurality of end flaps, and the method further comprises forming a handle in the closed end of the carton by at least partially overlapping the handle features.

* * * * *